US005979336A

United States Patent [19]

Nottingham et al.

[11] Patent Number: 5,979,336

[45] Date of Patent: Nov. 9, 1999

[54] DOOR MOUNTED IRONING BOARD

[75] Inventors: John R. Nottingham, Hunting Valley; John W. Spirk, Gates Mills; Richard O. McCarthy, Strongsville; Nicholas E. Stanca, Westlake; Jeffery M. Kalman, Cleveland Heights, all of Ohio

[73] Assignee: Whitney Design, Inc., St. Louis, Mich.

[21] Appl. No.: 08/782,548

[22] Filed: Jan. 10, 1997

[51] Int. Cl.[6] ..... A47B 23/00

[52] U.S. Cl. ..... 108/42; 38/103

[58] Field of Search ..... 108/42, 47, 48, 108/35, 38, 40, 152, 115; 38/103, 104, 137

[56] References Cited

U.S. PATENT DOCUMENTS

| | | | |
|---|---|---|---|
| 523,355 | 7/1894 | Kinley et al. . | |
| 667,164 | 1/1901 | Carder . | |
| 920,343 | 5/1909 | Kelly et al. . | |
| 1,506,240 | 8/1924 | Ines . | |
| 1,532,973 | 4/1925 | Adelson | 108/48 X |
| 1,558,409 | 10/1925 | Stienecker . | |
| 1,576,034 | 3/1926 | Butt . | |
| 1,696,145 | 12/1928 | Wagoner . | |
| 1,766,154 | 6/1930 | Triller . | |
| 1,843,391 | 2/1932 | Gayle . | |
| 1,868,185 | 7/1932 | Worley, Jr. et al. . | |
| 2,057,329 | 10/1936 | Duff . | |
| 2,236,717 | 4/1941 | Noack . | |
| 2,386,139 | 10/1945 | Rasmussen . | |
| 2,498,428 | 2/1950 | Kruse . | |
| 2,535,755 | 12/1950 | Rieter . | |
| 2,567,538 | 9/1951 | Anderson . | |
| 2,633,998 | 4/1953 | Derman . | |
| 2,743,023 | 4/1956 | Larson . | |
| 2,774,640 | 12/1956 | Harmon et al. | 108/47 X |
| 2,829,855 | 4/1958 | Gibson . | |
| 2,867,401 | 1/1959 | Sheahan . | |
| 2,925,916 | 2/1960 | Pollack . | |
| 2,959,297 | 11/1960 | Larson . | |
| 3,129,676 | 4/1964 | Brooks et al. . | |
| 3,170,417 | 2/1965 | Anidiya . | |
| 3,245,161 | 4/1966 | Adiletta et al. . | |
| 3,536,287 | 10/1970 | Kramer . | |
| 3,663,080 | 5/1972 | Ayers . | |
| 3,680,235 | 8/1972 | Leemhuis . | |
| 3,965,588 | 6/1976 | Long . | |
| 4,247,020 | 1/1981 | Dirksing . | |
| 4,318,486 | 3/1982 | Bobrowski . | |
| 4,382,641 | 5/1983 | Abel . | |
| 4,480,556 | 11/1984 | Wilson et al. . | |
| 4,510,872 | 4/1985 | Parry . | |
| 4,657,249 | 4/1987 | Offutt . | |
| 4,779,539 | 10/1988 | Stiglich | 108/48 |
| 4,862,611 | 9/1989 | Wright . | |
| 4,889,667 | 12/1989 | Miller et al. . | |
| 4,961,388 | 10/1990 | Simpson . | |
| 4,974,841 | 12/1990 | Miller et al. . | |
| 4,976,205 | 12/1990 | Jarriel et al. . | |
| 5,329,860 | 7/1994 | Mattesky . | |
| 5,483,761 | 1/1996 | Simpson . | |
| 5,570,642 | 11/1996 | Lehrman | 108/47 |
| 5,669,314 | 9/1997 | Grant | 108/48 |

FOREIGN PATENT DOCUMENTS

| | | |
|---|---|---|
| 309142 | 3/1989 | European Pat. Off. . |

*Primary Examiner*—Jose V. Chen

*Attorney, Agent, or Firm*—Polster, Lieder, Woodruff & Lucchesi, LLC

[57] ABSTRACT

A portable and adjustable ironing board system in which the ironing board may be securely affixed to a door is shown. The ironing board system of the present invention includes a singular support tube extending along the height of the door and securely attached to both upper and lower edges of the door. The ironing board system has an adjustable ironing board height and the singular support tube is adjustable to securely affix the tube to the door. The ironing board may be placed in the useful horizontal position or in the stored vertical position. The design of the ironing board system provides that the rear end of the ironing board slides along the support tube in a manner such that when in the vertical stored position the upper surface of the ironing board is facing outward. The ironing board can be locked in the downward horizontal position or in the stored vertical position by locking clamps. Further adjustment of the ironing board are allowed by the use of adjustment feet on the support frame.

31 Claims, 15 Drawing Sheets

DOOR MOUNTED IRONING BOARD

FIELD OF THE INVENTION

The present invention relates to ironing boards which are attached to a door, and more particularly to portable ironing boards which have a mounting assembly attaching said ironing board to a door and which unfold into a substantially horizontal position allowing the user to iron articles of clothing and which may be stored in a substantially vertical position.

DISCUSSION OF THE PRIOR ART

Door mounted ironing boards are fairly well known in the art. Particularly, most well known designs attached to a door at the top edge and are suspended therefrom. These suspended ironing board designs however suffer from substantial problems. First and foremost, the ironing boards are not securely attached to the door thereby allowing lateral shifting movement along the face of the door or allowing the ironing board assembly to slap back against the door when the door is opened. These problems are found in most designs wherein the ironing board is suspended from a single edge of a door.

Other non-portable ironing board designs are known wherein the ironing board frame is attached to the door by screws or other permanent devices. Solid attachment of the ironing board frame to the door may be possible but the ironing board loses portability and adjustability advantages. While both of these designs allow the ironing board to be stored in a vertical position, the drawbacks set forth are debilitating to the marketability and usability of the design.

U.S. Pat. No. 4,899,667 is directed towards a door mounted ironing board assembly wherein an inverted U-shaped support frame is suspended from a first and a second hook attached to the top edge of a door. The ironing board is pivotally attached to the frame allowing the ironing board to swivel about from a zero degree angle as compared to the door surface and which is considered the stored position, to a ninety degree angle from the door for use. However, as indicated above, this design suffers from many problems. First and foremost, the ironing board assembly suffers from the slap back effect when the door is opened and closed. Furthermore, this design may still cause lateral shifting of the frame while the ironing board is being used despite the fact that suction cups are applied to the back end of the inverted U-shaped support frame. Furthermore, this design suffers from the problem of not being adjustable for varying door heights and individual user heights.

SUMMARY OF THE INVENTION

The present invention is for an adjustable and portable door mounted ironing board which is affixed to both the upper and lower edge of a door and which allows the ironing board to be stored in a vertical position while also swiveling outward to a usable position which is ninety degrees from the door surface.

One object of the present invention is to provide a portable ironing board which resists lateral shifting on the door surface while the ironing board is in use.

Another object of the present invention is to provide a portable ironing board assembly which is adjustable to varying height doors so that the ironing board assembly may be securely attached to the door.

A further object of the present invention is to provide a portable and adjustable ironing board which allows the ironing board to be stored in a vertical position and used in a horizontal position while also allowing the ironing board to be stored in the vertical position with the upper surface of the ironing board facing outward such that the metal support structure of the ironing board is not visible when the ironing board is in the vertical stored position.

The present invention is directed towards a portable ironing board which has a single support tube frame attached to both upper and lower edges of a door. The support frame is adjustable for differing door heights. Additionally, the ironing board is foldable from a vertical stored position to a horizontal position for use. The butt end of the ironing board slides upwards on the single support tube frame for the stored position such that the upper surface of the ironing board is facing outwardly. The design of the present invention allows the ironing board assembly to be securely attached to the door preventing the undesirable slap back problems associated with prior art portable ironing board assemblies. The ironing board is supported by a support brace which has a first and a second support leg and which is hingedly attached to the underside of the ironing board. Each support leg of the support brace is pivotally attached to a support frame, said support frame being affixed to said support tube and slidable on said tube.

Finally, the present invention comprises a portable ironing board, comprising: a vertically extending support tube; an upper and lower bracket affixed at opposite distal ends of said support tube; means for adjusting the vertical height of said support tube; a support frame slidably attached to said support tube; an ironing board having a sliding collar hingedly attached to said ironing board at its rear end, said ironing board also hingedly attached at its underside to a support brace, said support brace pivotally attached to said support frame.

BRIEF DESCRIPTION OF THE DRAWINGS

A better understanding of the invention will be had upon reference to the following description in conjunction with the accompanying drawings in which the like numerals refer to like parts and wherein.

DETAILED DESCRIPTION OF THE PREFERRED EMBODIMENT

Figure 1:
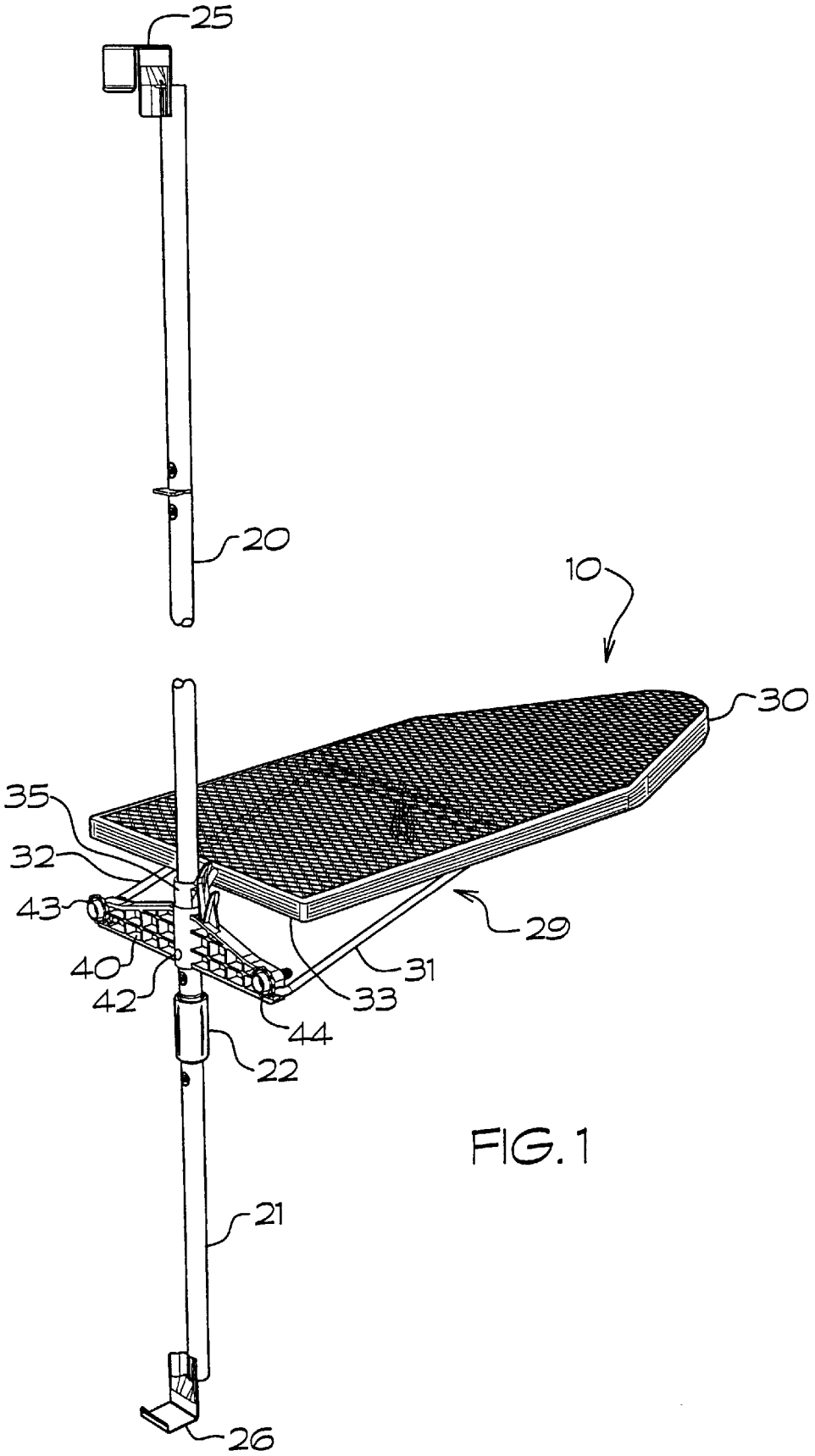
FIG. 1 is a perspective view of the portable and adjustable ironing board of the present invention.

Referring now to FIG. 1, the portable and adjustable ironing board of the present invention is shown. The ironing board system 10 of the present invention consists of a support tube 20 which extends vertically from the bottom of the door to the top of the door. Upper bracket 25 attached to one distal end of support tube 20 affixes to the upper edge of a door. The opposite distal end of the lower support tube 21 contains lower bracket 26 which attaches to the bottom edge of a door. Support tube 20 and lower support tube 21 are attached together at the adjustment collar 22. The support tube 20 and lower support tube 21, through the use of upper bracket 25 and lower bracket 26, are tightly affixed to the door preventing any lateral movement along the surface of the door. These brackets also prevent longitudinal movement which is defined as movement in the direction away from the planar surface of the door. Support tube 20 and lower support tube 21 may be made of any hard material which resists bending or deformation, such as steel or polypropylene and which will support the weight and pressure from use of the ironing board. Upper and lower brackets 25 and 26 are also made of a metal or polypropylene such that a secure attachment of the support tubes 20 and 21 to the door edges exists. Support tubes 20 and 21 may have a circular cross section in order to ease sliding of support collars utilized to attach the ironing board hardware and support structure. However, non-spherical support tubes or structure may be utilized.

The ironing board 30 shown in FIG. 1 has a butt end 33, said butt end 33 attached to the support tube 20 by sliding collar 35. Sliding collar 35 moves axially along support tube 20 such that the ironing board may be placed in the vertical position for storage or moved from the vertical storage position to the horizontal position shown in FIG. 1. Ironing board 30 is supported on the underside by support brace 29 which has a first support leg 31 and second support leg 32. Support brace 29 has a middle section 24, not shown in FIG. 1, which is hingedly attached to the underside of ironing board 30. This middle section 24 of the support brace 29 is more clearly shown in FIG. 3.

Returning back to FIG. 1, first and second support leg 31 and 32 are pivotally attached to support frame 40. Support frame 40 has a support frame collar 48 (see FIG. 5) for sliding over support tube 20 and for easy adjustment of the height of the ironing board and support frame. The support frame 40 and support frame collar 48 will be discussed in more detail herein. Sliding collar 35 which is hingedly attached to the butt end 33 of the ironing board 30 allows the ironing board to slide up support tube 20 such that the ironing board may be placed in the vertical stored position shown in FIG. 3. Sliding collar 35 may additionally be locked into place when ironing board 30 is placed in the horizontal position as is shown in FIG. 1. Additionally, support frame 40 has on its rear surface first and second adjustment feet 43 and 44 utilized to soften contact against the door surface.

Figure 2:
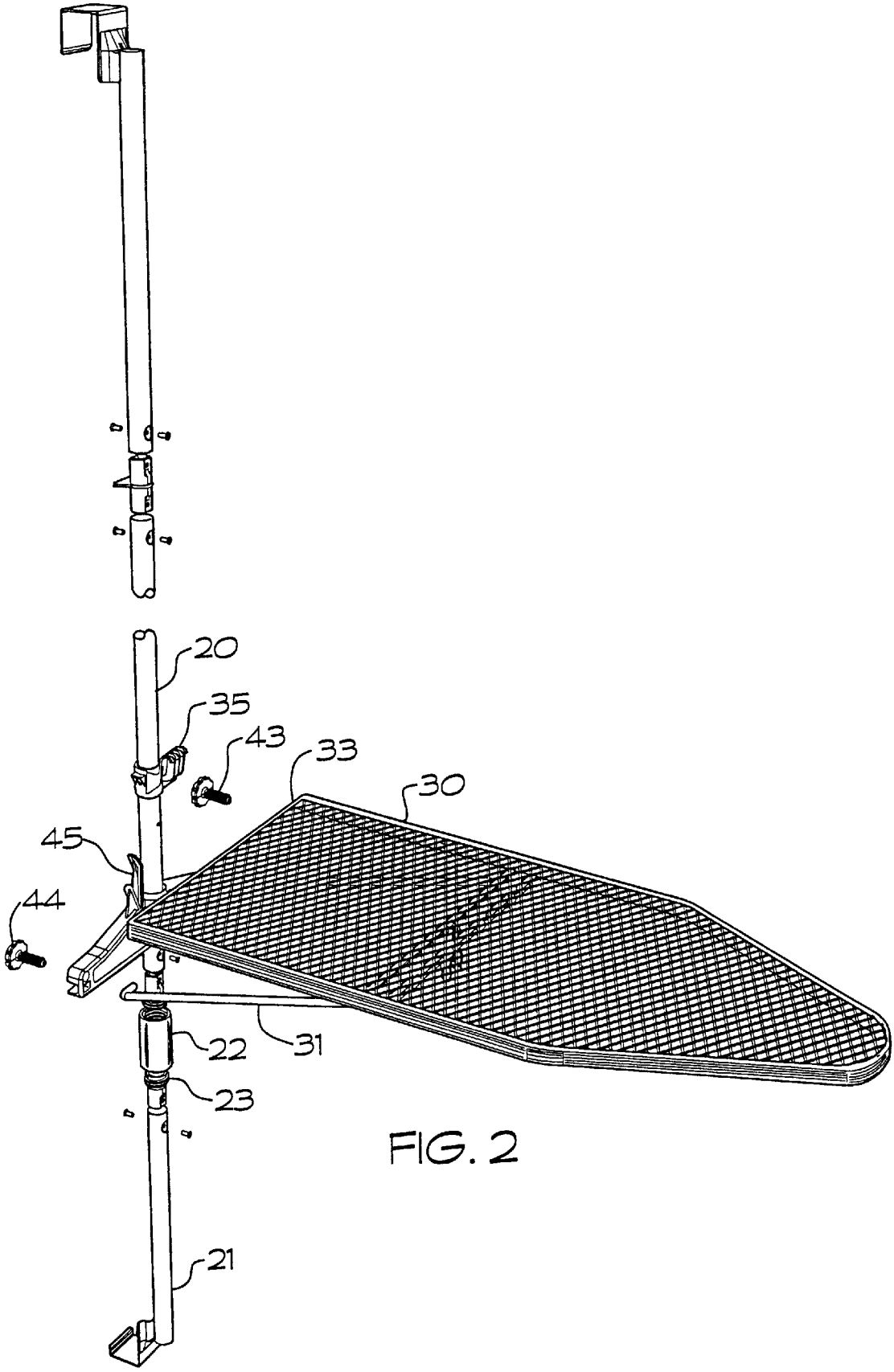
FIG. 2 is a perspective exploded view of the ironing board of FIG. 1.
Figure 8:
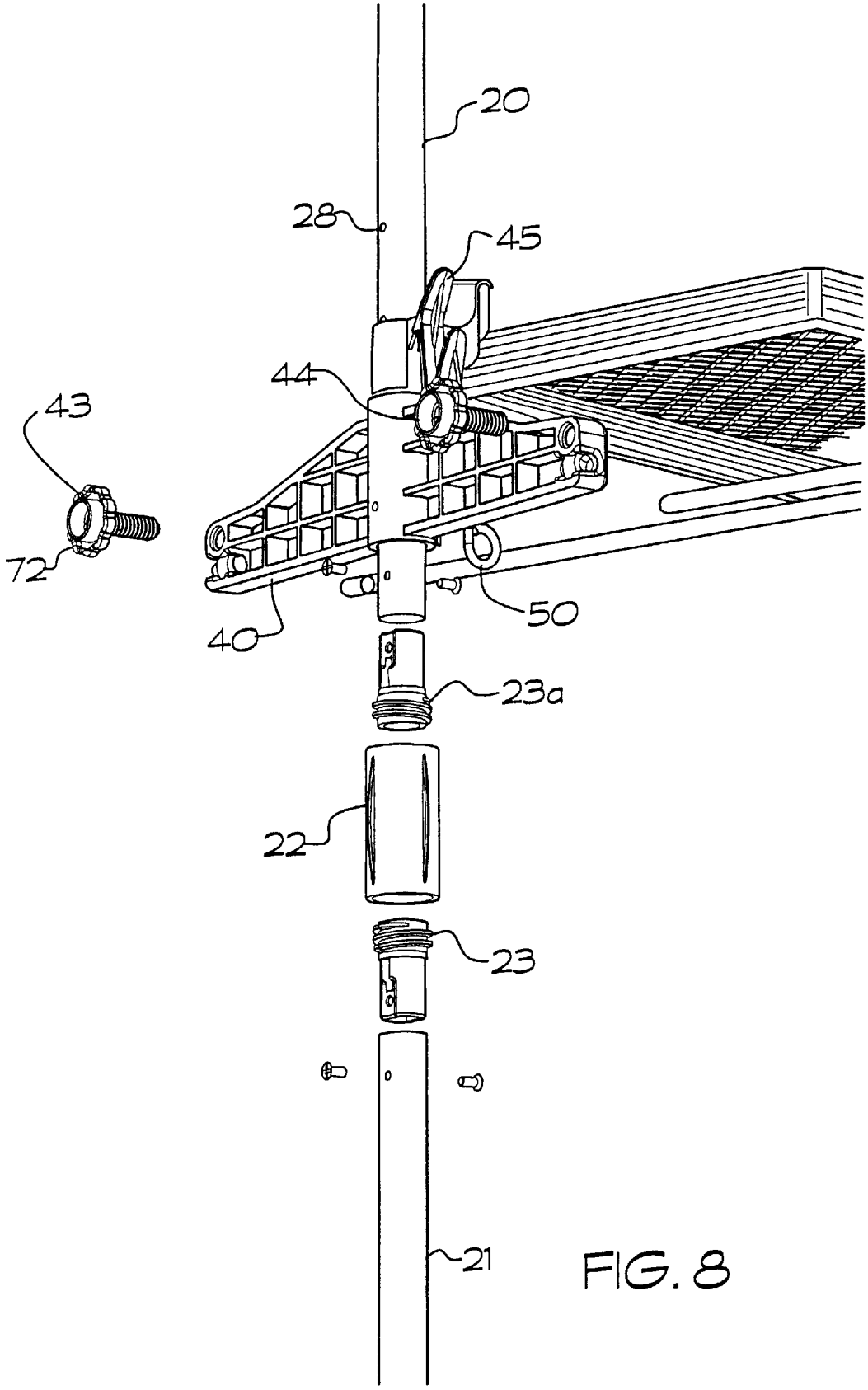
FIG. 8 is a perspective exploded view of the adjustable section of the support tube of the ironing board of FIG. 1.

Turning to FIG. 2, an exploded view of the portable and adjustable ironing board is shown. Support tube 20 and lower support tube 21 have on their distal ends adjacent to adjustment collar 22, threaded ends 23 and 23*a*, the entire assembly of which is shown in close-up in FIG. 8. As can be seen in FIG. 8, support frame 40 and first and second adjustment feet 43 and 44 are shown as well as frame securing eye bolt 50. Support frame 40 is affixed around support tube 20 via support frame collar 48 such that when the proper desired height is determined, support frame collar 48 can be attached to tube 20 through the use of one of a plurality of frame height adjusting apertures 28. The desired height is found for support frame 40 and the ironing board, frame securing eye bolt 50 is inserted through a hole formed on the support frame collar 48 and through the frame height adjusting aperture 28. This allows multiple possible heights for the board 30 which can be utilized based upon the individuals height and size of the door.

Returning back to FIG. 2, butt end 33 of the ironing board 30 is hingedly attached to sliding collar 35 which allows axial movement of the ironing board along support tube 20. Sliding collar 35, shown close-up in FIG. 7, has board hinge structure 49 for attachment to the underside of the ironing board 30 via the U-shaped bracket 39 shown in FIG. 6. A pin or other securing means is inserted through the apertures on both legs of the U-shaped bracket and through the board hinge structure 49 of the sliding collar 35 such that the butt end 33 of the board 30 is hingedly mounted to the sliding collar 35. Also shown in FIG. 8 are the first and second adjustment feet 43 and 44 which are threadably received into support frame 40. The contact surface 72 of adjustment foot 43 is made of a soft or other non-abrasive material such that the support frame 40 may be tightened against the surface of the door without causing marks or scratches. Adjustment feet 43 and 44, as shown in FIG. 8, are threadably received into support frame 40 so that proper adjustment and secure placement of the frame 40 in the portable and adjustable ironing board system 10 occurs. These adjustment feet assure secure attachment of the ironing board and frame to the door. Adjustment feet 43 and 44 additionally act to stabilize the ironing board and support frame and support tube when the ironing board is in use.

Figure 3:
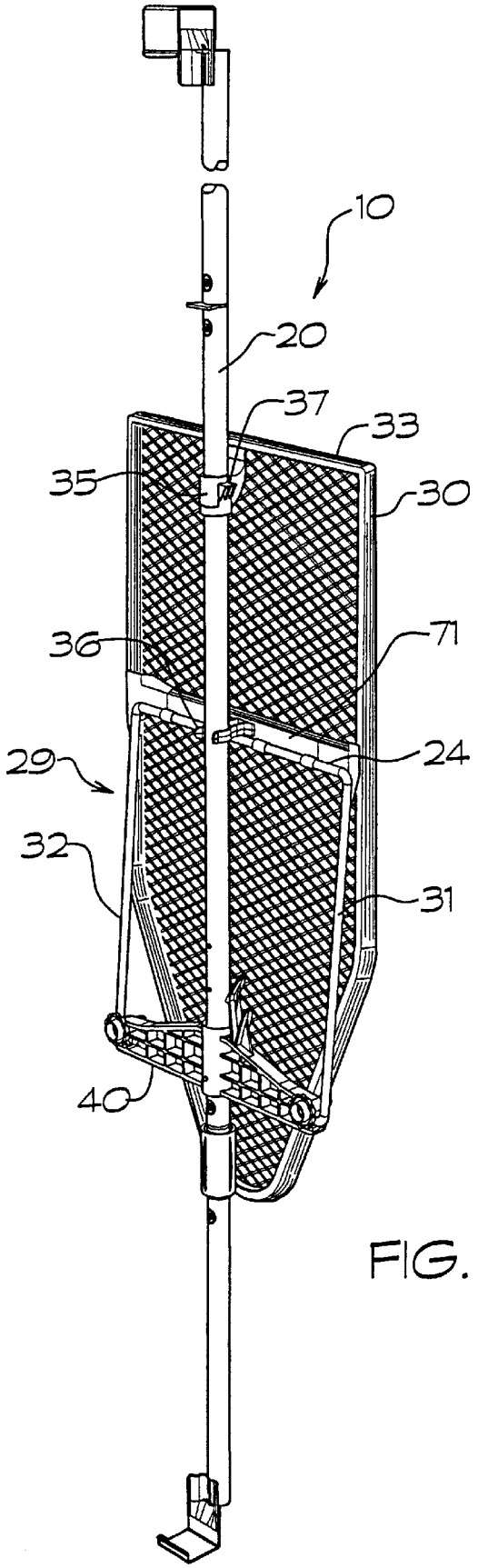
FIG. 3 is a perspective view of the portable ironing board of FIG. 1 wherein the board is in the stored position.
Figure 4:
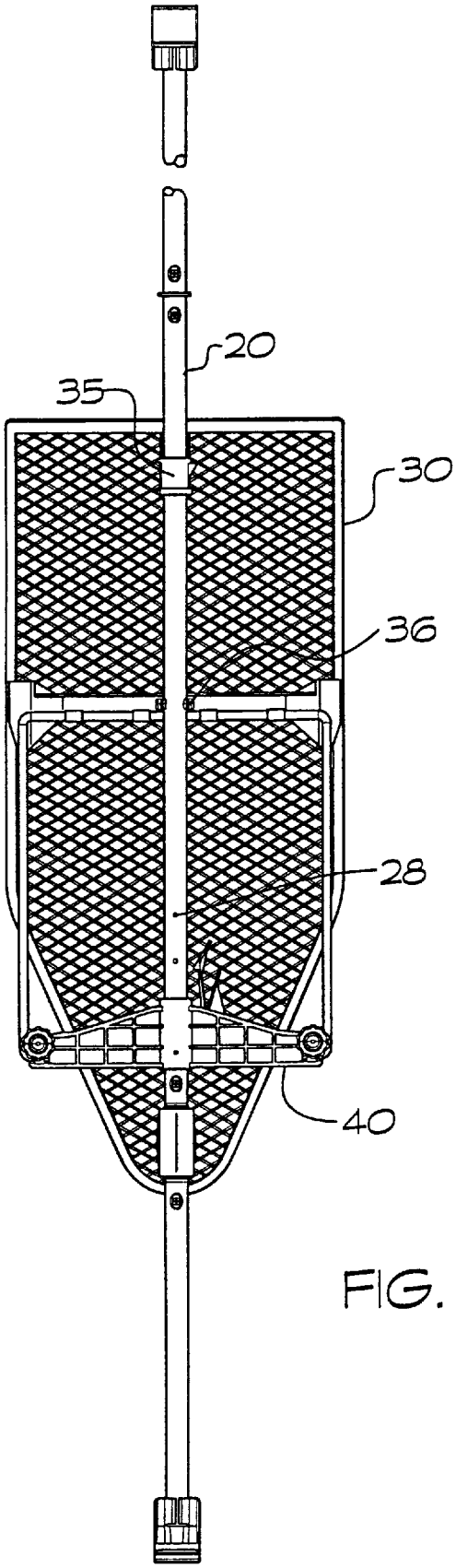
FIG. 4 is a rear view of FIG. 3.

Turning now to FIG. 3, the ironing board system 10 of the present invention is shown in the vertical stored position. Ironing board 30 having butt end 33 hingedly attached to the sliding collar 35 is moved to its upper most position along support tube 20. Storage clamp 36 provided along the mid-section brace 71 of ironing board 30 clamps around support tube 20 keeping the ironing board in the vertical position as shown. Support legs 31 and 32 pivot within each leg receptacle 47 of support frame 40 allowing midsection 24 of support brace 29 to move upward with the ironing board 30. When stored in the vertical position, as is shown, storage clamp 36 prevents the ironing board from moving into the horizontal position. The ironing board 30 and storage clamp 36 are also shown in the vertical stored position in FIG. 4. As indicated, clamp 36 securely holds the ironing board 30 in the vertical position by preventing axial movement along support tube 20. Frame height adjusting apertures 28 are also clearly shown in FIG. 4 which allow the user to change the height of support frame 40 on support tube 20 by frame securing eye bolt 50 shown in FIG. 8.

Figure 5:
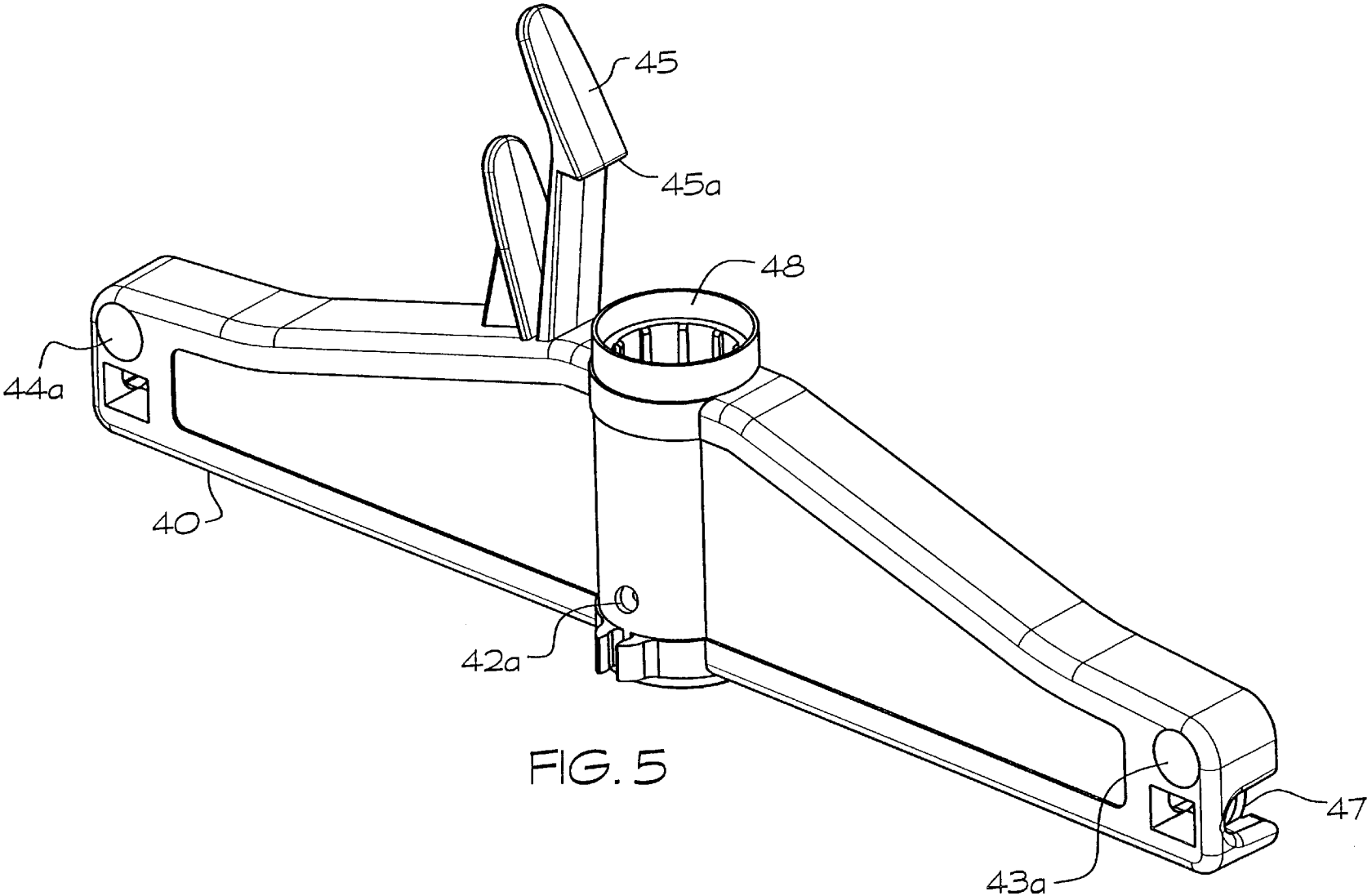
FIG. 5 is a perspective view of the support frame of the ironing board in FIG. 1.
Figure 7:
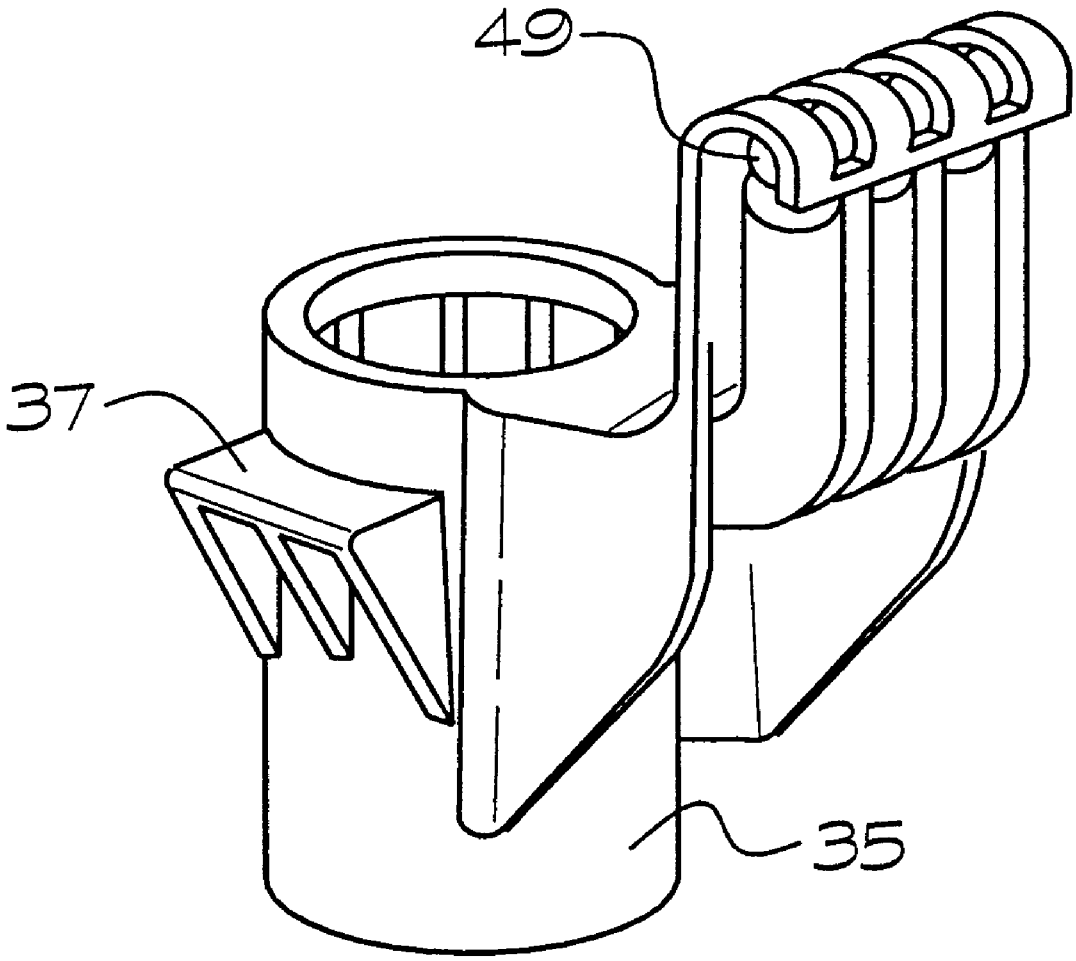
FIG. 7 is a perspective view of the sliding collar used to attach the ironing board to the support tube in the ironing board of FIG. 1.

Returning now to FIG. 5, the support frame 40 and support frame collar 48 are shown in close-up. Threaded apertures 43*a* and 44*a* for receiving adjustment feet 43 and 44 are delineated so that the ironing board system 10, as previously mentioned, may be securely fastened against the door thereby preventing any lateral or longitudinal shifting movement of support frame 40. Additionally, pin aperture 42*a* for receiving frame securing eye bolt 50, not shown in this Figure, is provided for proper height adjustment of the support frame 40 along support tube 20. Additionally shown and in clear view in FIG. 5, collar locking member 45 is present to lock sliding collar 35 in the fully downward position corresponding to the ironing board 30 being in the horizontal position. Collar locking member 45 co-acts with collar locking ridge 37 found on sliding collar 35 which is shown in FIG. 7. As sliding collar 35 moves downward on the support tube 20, locking ridge 37 pushes the locking member 45 outward until ridge 37 is below locking surface 45*a* on the collar locking member 45. The functional engagement of the locking surface 45 and the locking ridge 37 insures that the ironing board remains in a substantially flat horizontal position during use. Collar locking member 45 must be somewhat flexible and as such, is preferred to be made of a polypropylene or other plastic material. Once the ironing board 30 is in the horizontal position, as is shown in FIG. 1, to release the sliding collar 35 from the locked downward position, a rearward force is applied to the collar locking member 45 releasing sliding collar 35 and allowing the butt end 33 of ironing board 30 to slide axially upward along the support tube 20. Also shown in FIG. 5 is the leg receptacle 47 which pivotally receives the support leg 31 of support brace 29. A second leg receptacle may be found on the opposite end of the frame 40.

Figure 6:
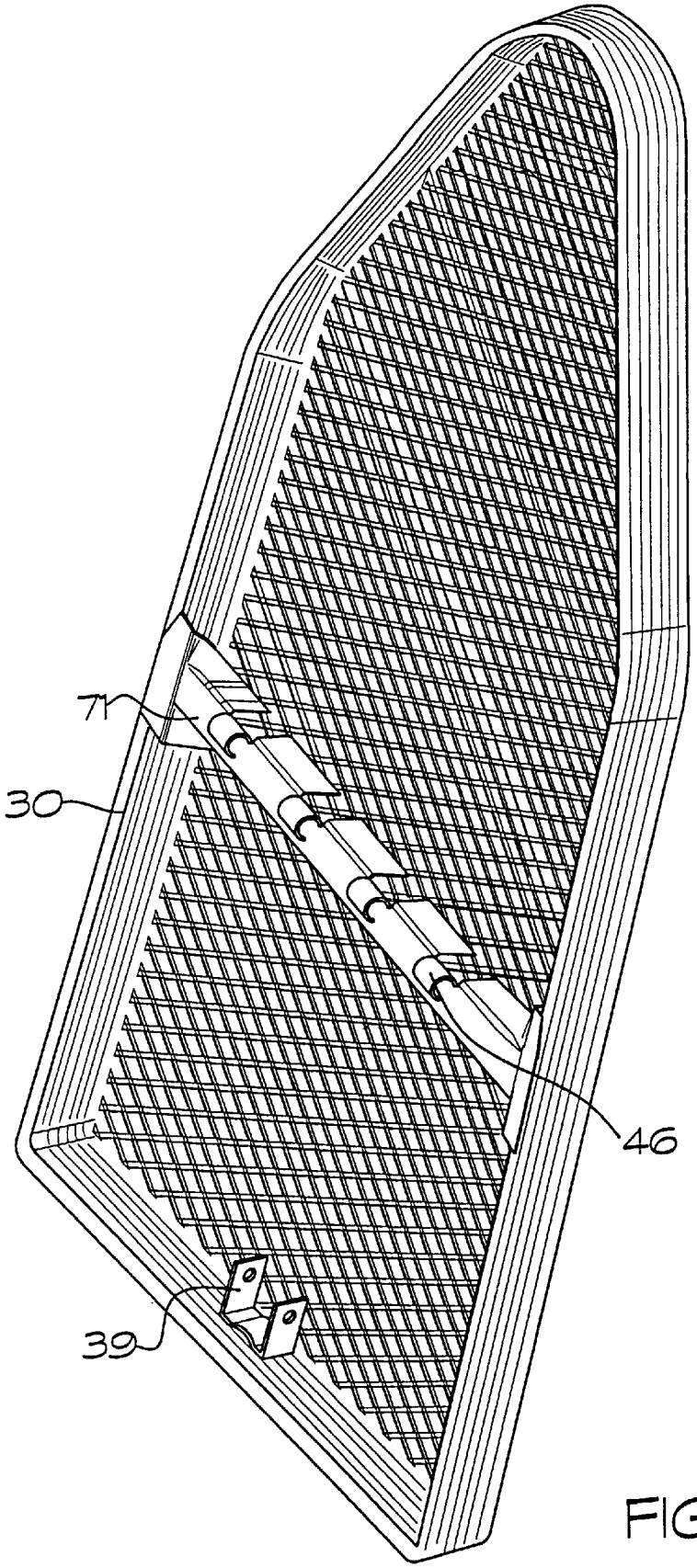
FIG. 6 is a perspective underside view of the ironing board of FIG. 1.

Turning now to FIG. 6, the underside of the ironing board 30 is shown. U-shaped bracket 39 which receives the sliding collar 35 has apertures on each leg such that a pin or other securing means may be inserted therethrough and through the board hinge structure 49 of sliding collar 35 shown in FIG. 7. This structure allows the butt end of the ironing board to be hingedly attached to the sliding collar 35 for sliding of the ironing board in the vertical direction. Also shown in FIG. 6 are support brace receiving clamps 46 which receive the mid-section 24 of the support brace 29. After insertion of the middle section 24 to the brace receiving clamps 46, the support brace 29 is hingedly attached to the mid-section support member 71.

Turning now to FIG. 8, adjustment collar 22 is shown for threadably receiving threaded ends 23*a* of the support tube 20 and lower support tube 21. While shown in FIG. 8 as an independent tube section attached to support tube 20 and lower support tube 21, threaded ends 23*a* and 23 may also be formed at each distal end of support tube 20 and lower support tube 21 negating the use of separate threaded ends 23 and 23*a* as is shown. Adjustment collar 22 is threaded on the interior surface for receiving threaded ends 23 and 23*a*. The threads in the lower and upper portion of adjustment collar 22 are oppositely threaded such that turning of the adjustment collar 22 in one direction causes the threaded ends 23 and 23*a* of the support tube 20 and lower support tube 21 to either move away from each other or towards each other depending on the rotation direction of adjustment collar 22. Adjustment collar 22 allows the upper and lower brackets 25 and 26, shown in FIG. 1, to be securely attached to the upper and lower edge of the door by increasing or decreasing the overall combined length of support tubes 20, 21.

Figure 9:
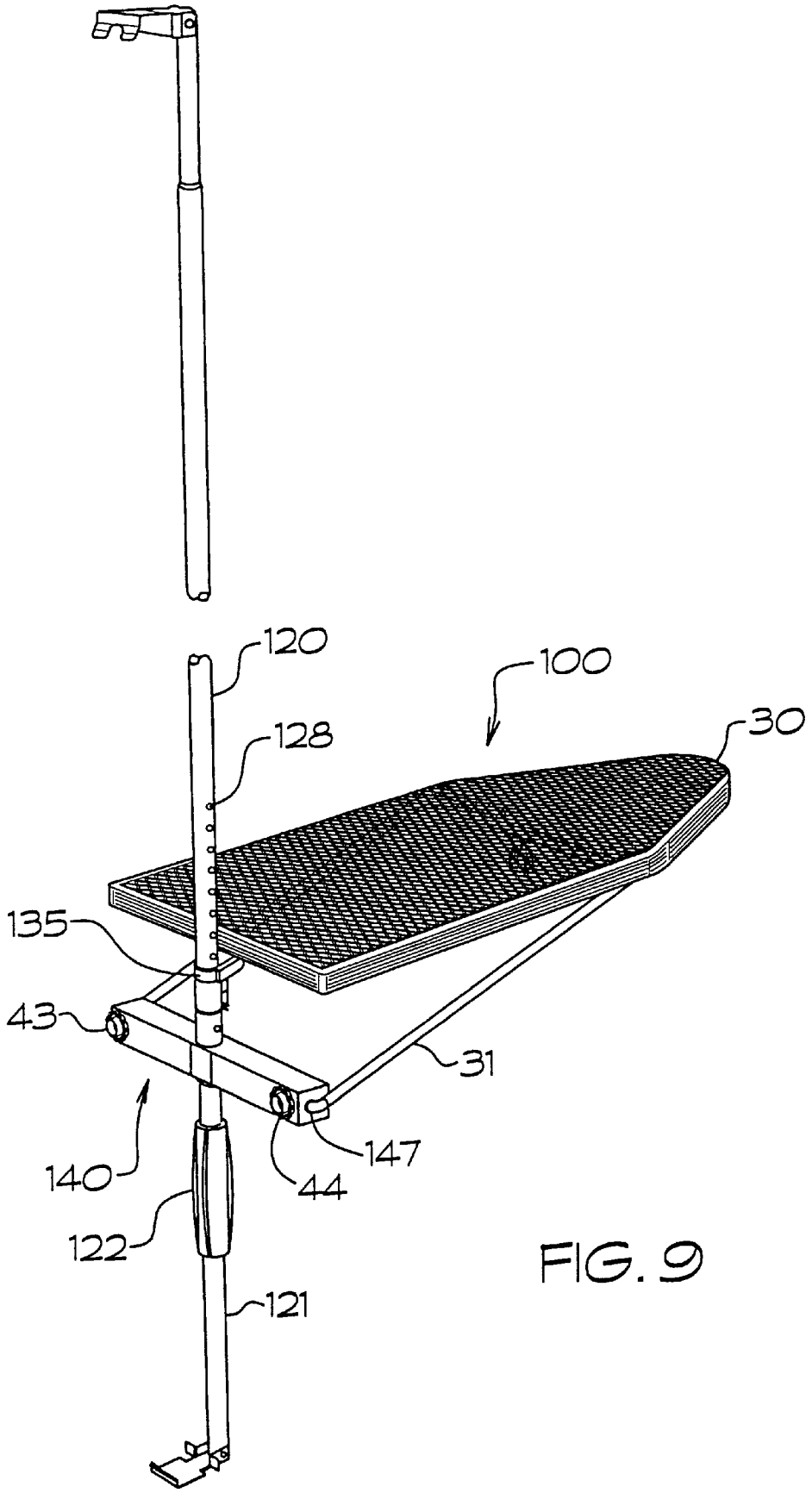
FIG. 9 is a perspective view of an alternative embodiment of the ironing board of the present invention.

In FIG. 9, an alternative embodiment 100 of the portable and adjustable ironing board system is shown. A simplified support frame 140 which receives the first and second support legs 31 and 32 of the support brace 29 in the frame leg receptacle 147 is utilized to support the ironing board 30. Multiple height adjusting apertures 128 are formed in the upper support tube 120 for adjustment of the horizontal height of ironing board 30. First and second adjustment feet 43 and 44 are again used and are threadably inserted into the support frame 140. Upper and lower support tubes 120 and 121 are threadably affixed together by adjustment collar 122. As in the prior embodiment, support collar 135 slides upwards along upper support tube 120 to store the ironing board in the vertical stored position.

Figure 10:
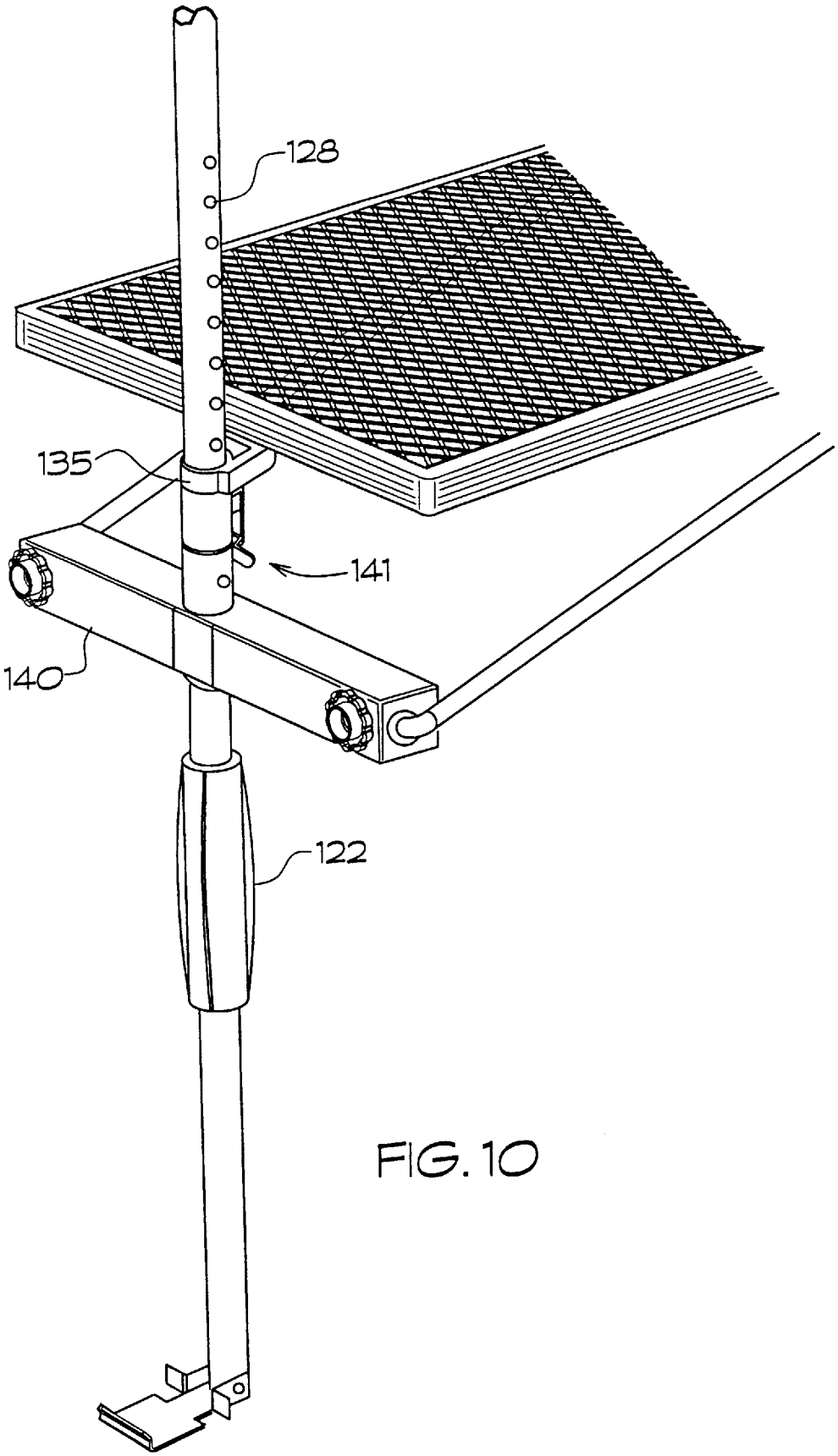
FIG. 10 is close-up perspective view of the support frame and height adjustment means of the alternative embodiment used in the ironing board of FIG. 9.
Figure 11:
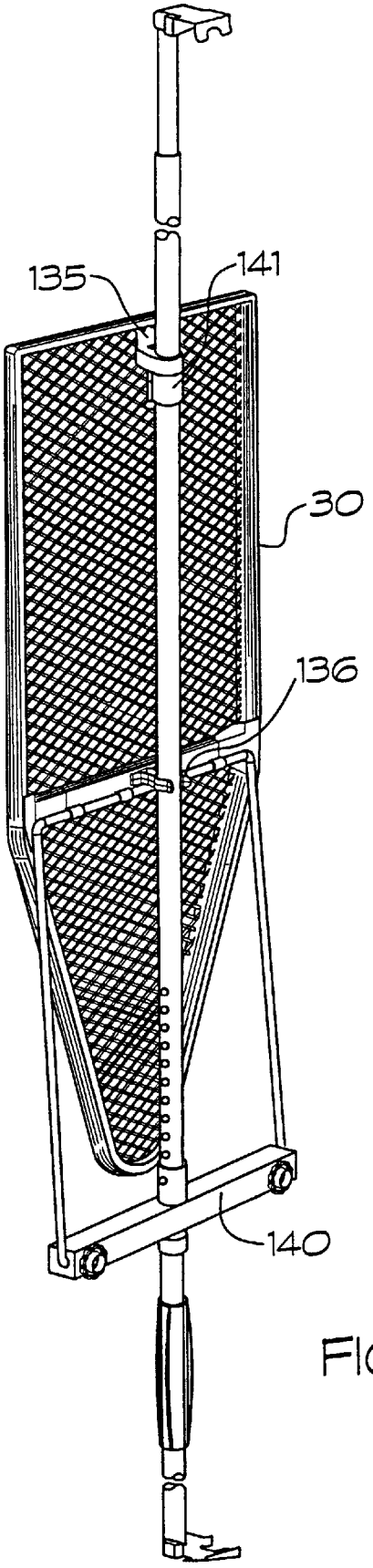
FIG. 11 is a rear perspective view of the ironing board of FIG. 9 wherein the ironing board is in the stored vertical position.
Figure 12:
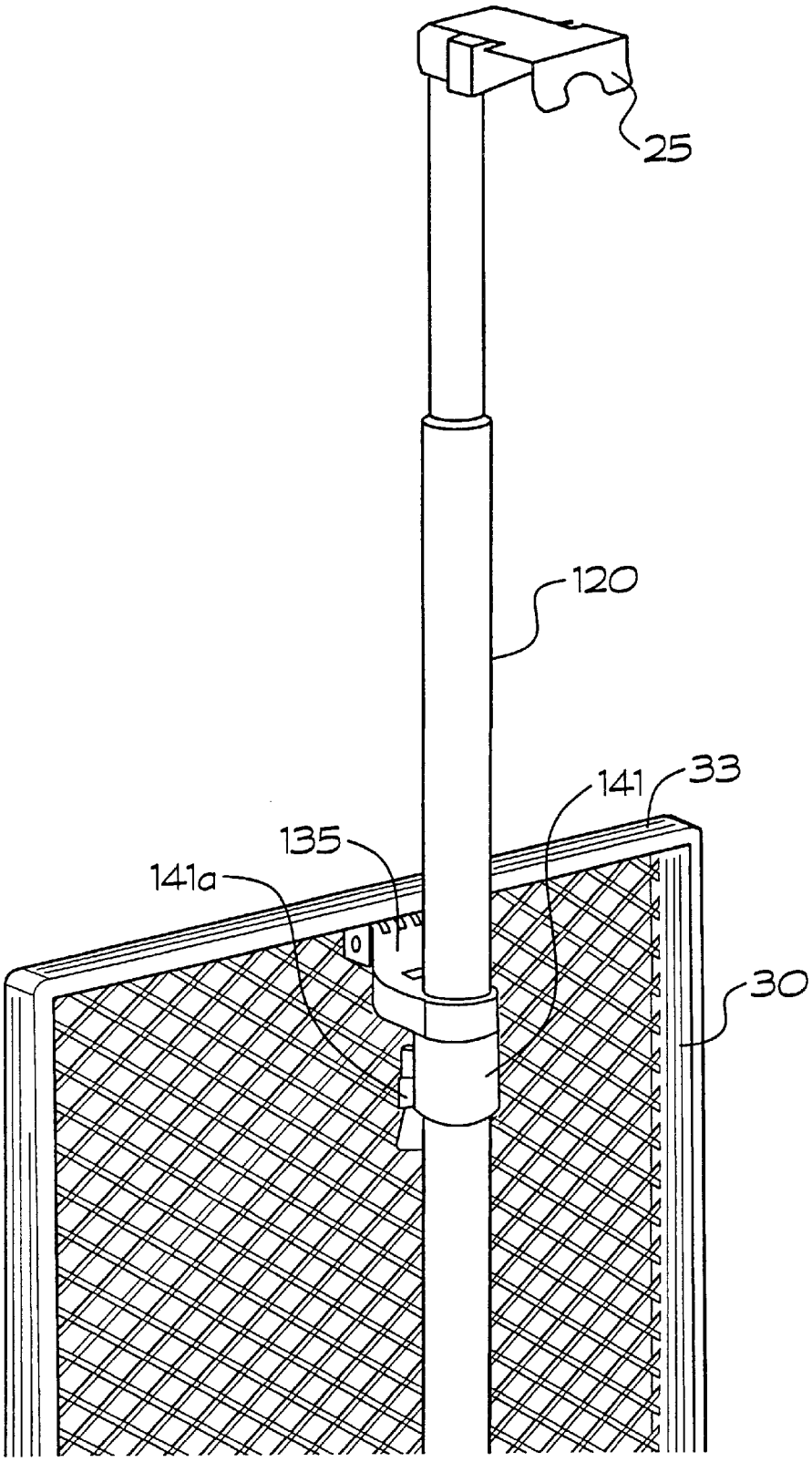
FIG. 12 is a close-up rear view of the support collar and locking assembly of the ironing board shown in FIG. 9.

As shown in more detail in FIG. 10, the support frame 140 and sliding collar 135 are shown. Additionally, locking collar 141 is utilized to secure the ironing board 30 in a horizontal position. Similarly, shown in FIG. 11, locking clamp 136 secures the ironing board 30 in the vertical position allowing the locking collar 141 and support collar 145 to remain at their upper most position. In FIG. 12, sliding collar 135 is shown and is hingedly attached to the underside of the ironing board frame 30 such that the butt end of the ironing board may swivel about the hinge formed on the sliding collar 135. As previously mentioned, locking collar 141 is utilized to secure the ironing board in the horizontal position and will be discussed in further detail herein.

Figure 13:
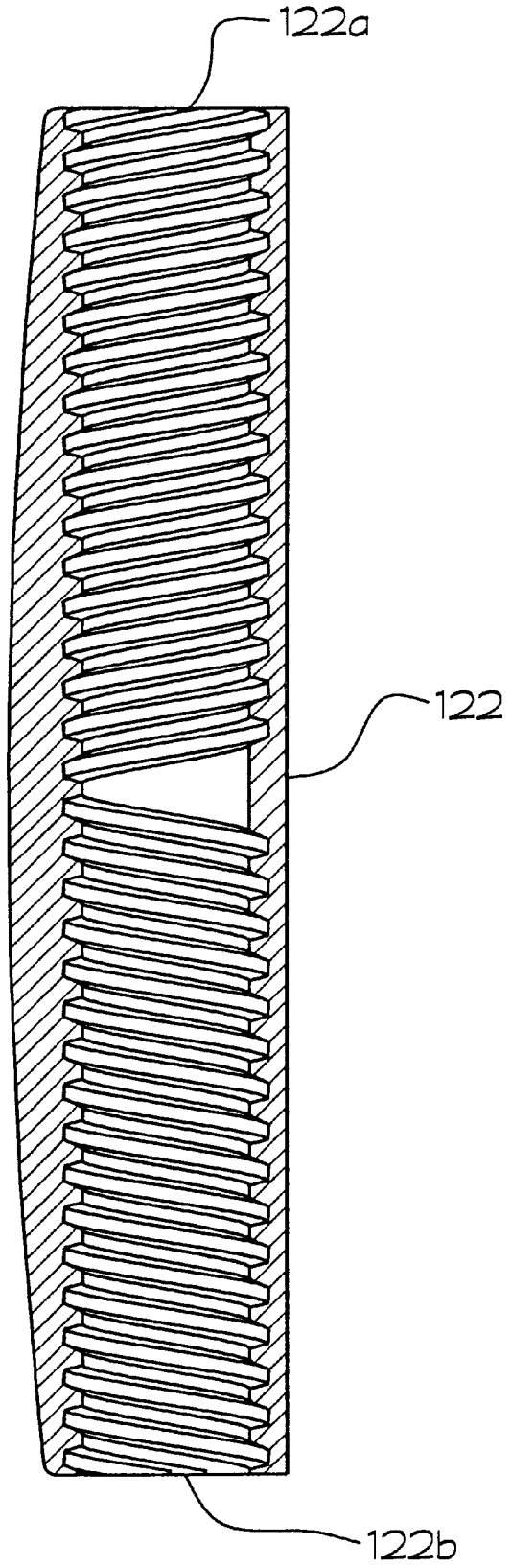
FIG. 13 is a sectional view of the adjustment collar for the ironing board shown in FIG. 9.

Turning to FIG. 13, the adjustment collar 122 is shown with ends 122*a* and 122*b* being distinctly threaded portions of the adjustment collar 122. Upper adjustment collar portion 122*a* is internally threaded such that the threads are left handed threads for receiving the lower threaded end of the upper support tube 120. The lower portion 122*b* of the adjustment collar 122 is additionally distinctly threaded internally by having right ended threads for receiving the threaded end of lower support tube 121. Thus, by rotating the adjustment collar 122 in a single direction the threaded ends of the lower and upper support tube 121 are either forced apart or brought together depending upon the direction of rotation of the adjustment collar 122. The ability to adjust the height of the support tubes 120 and 121 and their upper and lower attachment brackets 25 and 26, affixing the support tubes 120 and 121 to a door insures that the portable and adjustable ironing board system 100 is tightly and securely attached to the surface of the door. This same adjustable structure of the adjustment collar is also found on the collar 22 of the first embodiment.

Figure 14:
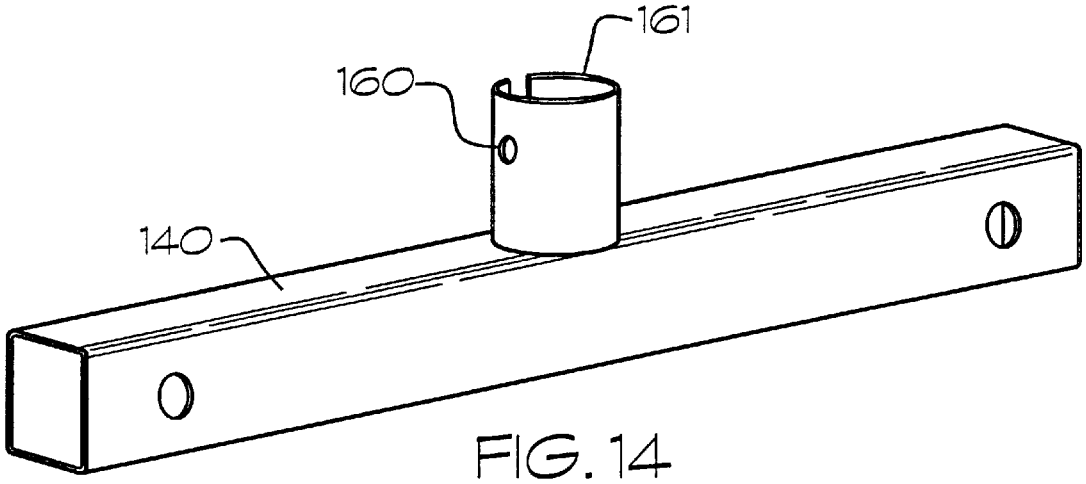
FIG. 14 is a perspective view of the support frame of the ironing board shown in FIG. 9.

Turning to FIG. 14, the support frame 140 of the ironing board system 100 shown in FIG. 9 is displayed. Support frame collar 161 is formed in the support frame such that the frame 140 may slide upward or downward onto the upper support tube 120. Once an adequate height for ironing board 30 is determined, a pin is inserted through support frame aperture 160 and into one of the proper height adjustment apertures 128 formed on the support tube 120.

Figure 15:
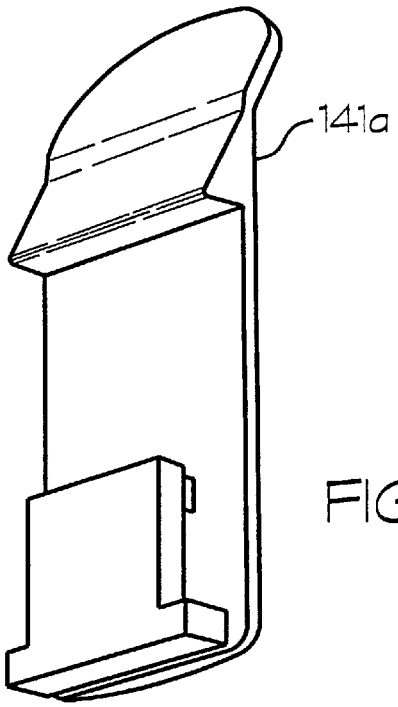
FIG. 15 is a perspective view of the locking clamp attached to the locking collar for the ironing board shown in FIG. 9.
Figure 16:
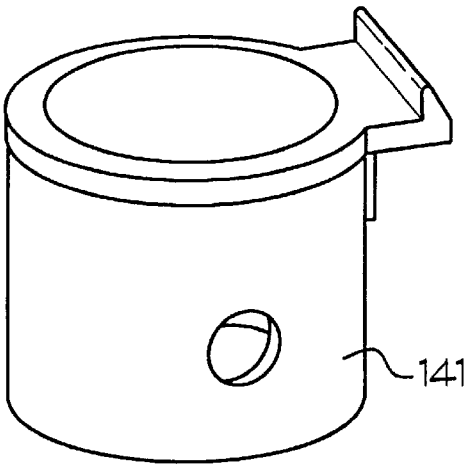
FIG. 16 is a perspective view of the locking collar for the ironing board shown in FIG. 9; and, FIG. 17 is a perspective view of an alternative embodiment for the adjustment collar.

Locking clamp 141*a* shown in FIG. 15 is attached to locking collar 141 which forms a portion of support collar 135. Thus, as support collar 135 slides axially along upper support tube 120, locking collar 141 slides therewith. A similar locking ridge, as previously described, is formed along the support frame collar 161 allowing the locking clamp 141*a* to securely lock the ironing board 30 in the horizontal position as is shown in FIG. 10. The simplified form of the alternative ironing board system 100 allows use of a singular rectangular or square support frame 140 which may be comprised of either a metal or plastic material while also providing full adjustability of the height of the ironing board and tight attachment to the door.

Figure 17:
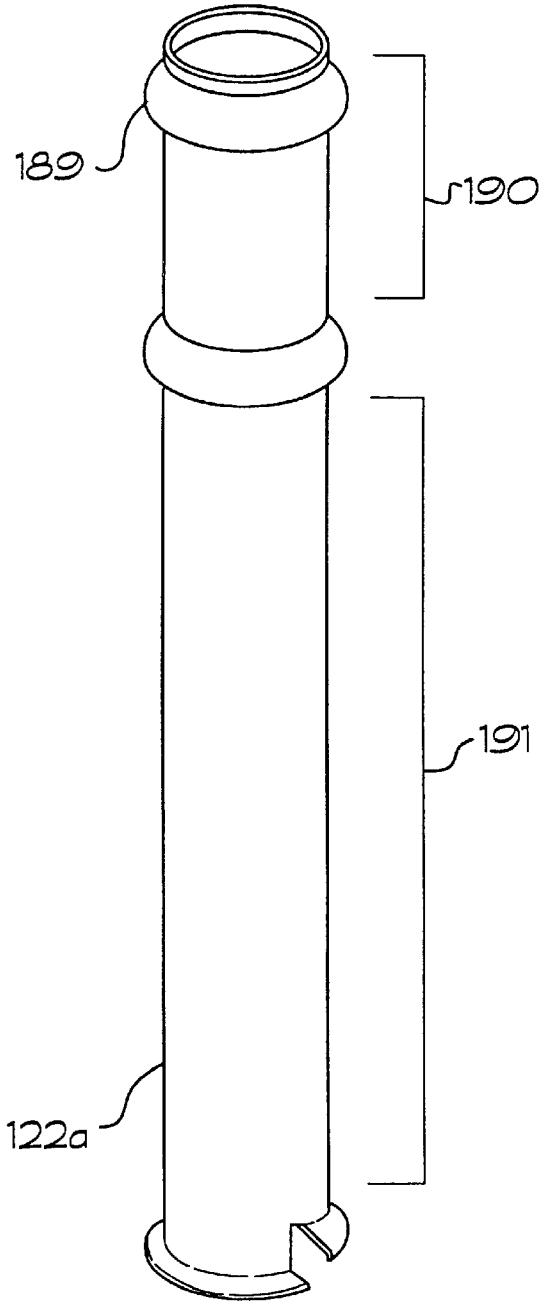

In FIG. 17, an alternative embodiment to the adjustment collar 122*a* is shown. This adjustment collar 122*a* has a single threaded interior surface along section 191 and a smooth interior section 190 which retains a single end of either the lower or upper support tube. Thus, with the design of the alternative adjustment collar 122*a*, only the upper or lower portion of the support tube is threaded into the interior of the adjustment collar. The opposite end of the adjustment collar has a ridge 188, which mates with another ridge on the distal end of the non-threaded end of the support tube so that rotation of the adjustment collar spins freely on said end.

The foregoing detailed description is given primarily for clearness of understanding and no unnecessary limitations are to be understood therefrom for modifications will become obvious to those skilled in the art upon reading this disclosure and may be made without departing from the spirit of the invention or the scope of the appended claims.

What we claim:

1. A portable ironing board, comprising:

a vertically extending support tube;

an upper and lower bracket affixed at opposite distal ends of said support tube;

means for adjusting the vertical height of said support tube;

a support frame slidably attached to said support tube;

an ironing board having a sliding collar slidingly mounted to said support tube, said sliding collar being hingedly attached to said ironing board at its rear end, said ironing board also hingedly attached at its underside to a support brace, said support brace pivotally attached to said support frame.

2. The ironing board of claim 1 wherein said vertically extending support tube is an upper support tube and a lower support tube, each of said upper and lower support tubes having a threaded end opposing each other.

3. The ironing board of claim 2 wherein said means for adjusting the vertical height of said support tube comprises an adjustment collar threadably receiving said threaded ends of said upper and lower support tubes.

4. The ironing board of claim 3 wherein said adjustment collar has an upper interior threaded portion and a lower interior threaded portion, said upper portion oppositely threaded as compared to said lower portion.

5. The ironing board of claim 1 wherein said support frame has a support frame collar for receiving said support tube, said frame extending outward on both sides from said collar.

6. The ironing board of claim 5 wherein said support fame collar has an aperture for receiving a frame securing eyebolt, said support tube having a plurality of apertures for receiving said securing eyebolt, said eyebolt inserted through said support frame collar and one of said apertures on said support tube.

7. The ironing board of claim 1 wherein said support brace is comprised of a first support leg, a second support leg and a mid-section, said mid-section being hingedly attached to underside of said ironing board.

8. The ironing board of claim 7 wherein said support frame has a first and a second leg receptacle for pivotally receiving said first and second support leg of said support brace.

9. The ironing board of claim 8 wherein said support frame extends outward and away from said support tube on both sides, said support brace transmitting pressure from use of said ironing board to both sides of said support frame.

10. The ironing board of claim 1 wherein said support frame threadably receives a first and a second adjustment foot.

11. The ironing board of claim 10 wherein said first and second adjustment foot are further comprised of a soft head facing away from said support frame and a threaded bolt.

12. The ironing board of claim 1 wherein said upper bracket is an inverted U-shaped bracket and said lower bracket is a U-shaped bracket, said brackets able to engage the upper and lower edge of a door.

13. The ironing board of claim 1 wherein said sliding collar has a collar locking ridge and said support frame has a mating collar locking member, said collar locking member engagable with said collar locking ridge to hold said ironing board in a horizontal position.

14. The ironing board of claim 1 wherein said ironing board has a mid-section brace on the underside of said ironing board, said ironing board further having a storage clamp attached to said mid-section brace for clamping onto said support tube to hold said ironing board in a vertical position.

15. A portable ironing board, comprising:

a vertically extending support tube;

means to attach said support tube to the upper and lower edge of a door;

a support frame attached to said support tube;

an ironing board slidably attached to said support tube, and means for connecting the ironing board to the support frame so that the ironing board can pivot relative to the support frame as the ironing board slides relative to the support tube; and means for locking said ironing board to said support tube in a horizontal position relative to a vertical position of the support tube.

16. The ironing board of claim 15 wherein said means to attach said support tube to said door comprises an upper inverted U-shaped bracket at one distal end of said support tube and a U-shaped bracket at the opposite distal end of said support tube.

17. The ironing board of claim 15 further comprising means to adjust the vertical height of said support tube.

18. The ironing board of claim 17 wherein said means to adjust is comprised of a internally threaded adjustment collar.

19. The ironing board of claim 18 wherein said support tube is further comprised of an upper and lower support tube, said adjustment collar threadably receiving adjacent ends of said upper and lower support tubes.

20. The ironing board of claim 15 wherein said ironing board is further comprised of a sliding collar hingedly attached to the rear end of said ironing board, said sliding collar slidable along said support tube.

21. The ironing board of claim 20 wherein said support frame has means to lock said sliding collar in place to keep said ironing board in a horizontal position.

22. The ironing board of claim 15 wherein said ironing board is further comprised of a support brace, said support brace having a first and a second leg and a mid-section therebetween, said mid-section hingedly attached to the underside of said ironing board, said first and second legs pivotally attached to said support frame.

23. The ironing board of claim 15 further comprising a first and a second adjustment foot threadably attached to said support frame.

24. The ironing board of claim 23 wherein said first and second adjust foot have a soft outer head for engaging said door.

25. The ironing board of claim 15 further comprising means to adjust the height of said ironing board when said ironing board is in the horizontal position.

26. The ironing board of claim 25 wherein said means to adjust the height of said ironing board is comprised of a plurality of apertures in said support tube and an aperture in said support frame, each of said apertures designed to receive a height adjusting pin which is inserted through said support frame and one of said plurality of apertures in said support tube.

27. A portable ironing board, comprising:

a vertically extending support tube having an upper and lower support tube portion, said upper support tube portion having a plurality of pin receiving apertures;

an upper and lower bracket affixed at opposite distal ends of said support tube to engage the upper and lower edge of a door;

an adjustment collar for threadably receiving adjacent ends of said upper and lower support tube portions;

a support frame having a support collar, said support collar slidably attached to said support tube and having a frame securing pin aperture for alignment with an aperture in the upper support tube portion, and a pin securing member insertable through said support tube portion aperture and said support frame aperture to hold the support frame in fixed position relative to the upper support tube position;

an ironing board having a rear end adjacent to said support tube, said ironing board hingedly attached at said rear end to a sliding collar, said sliding collar slidable along said upper support tube;

a support brace having a mid-section, a first leg and a second leg, said mid-section hingedly attached to the underside of said ironing board, said first and second leg pivotally attached to said support frame.

28. The ironing board of claim 27 wherein said sliding collar has a locking ridge engagable with a collar locking member extending upwardly from said support frame, said locking ridge and said collar locking member engagable to lock said ironing board in the horizontal position.

29. The ironing board of claim 27 further comprising a U-shaped storage clamp attached to the underside of said ironing board, said storage clamp expandable to receive said upper portion of said support tube to lock said ironing board in the vertical position.

30. The ironing board of claim 27 further comprising a support frame securing bolt for inserting through said securing pin aperture and one of said plurality of pin receiving apertures in said upper support tube portion.

31. A portable ironing board detachably affixed to a door, comprising:

a vertically extending support tube, said support tube having means for being attached at opposite distal ends to the upper and lower edges of said door;

a support frame slidably attached to said support tube;

an ironing board slidably attached to said support tube above said support frame, and means for connecting the ironing board to the support frame so that the ironing board can pivot relative to the support frame as the ironing board slides relative to the support tube;

means for locking said ironing board in a horizontal position; and, means for locking said ironing board in a vertical position.

* * * * *

UNITED STATES PATENT AND TRADEMARK OFFICE

CERTIFICATE OF CORRECTION

PATENT NO. : 5,979,336
DATED : November 9, 1999
INVENTOR(S) : Nottingham et al.

It is certified that error appears in the above-identified patent and that said Letters Patent is hereby corrected as shown below:

Column 7,
Line 9, change "ridge 188" to -- ridge 189 --

Column 10,
Line 32, add as another claim the following: -- 32. The ironing board of claim 31 further comprising means for adjusting the vertical link of said support tube. --

Signed and Sealed this

Second Day of July, 2002

*Attest:*

*Attesting Officer*

JAMES E. ROGAN
*Director of the United States Patent and Trademark Office*